US010576531B2

(12) United States Patent
Shimohira et al.

(10) Patent No.: US 10,576,531 B2
(45) Date of Patent: Mar. 3, 2020

(54) METHOD AND APPARATUS FOR PRODUCING FORGING BY ROTARY FORGING

(71) Applicant: HITACHI METALS, LTD., Minato-ku, Tokyo (JP)

(72) Inventors: Eiji Shimohira, Yasugi (JP); Koji Sato, Yasugi (JP); Tsuyoshi Fukui, Yasugi (JP)

(73) Assignee: Hitachi Metals, LTD., Tokyo (JP)

( * ) Notice: Subject to any disclaimer, the term of this patent is extended or adjusted under 35 U.S.C. 154(b) by 602 days.

(21) Appl. No.: 15/285,766

(22) Filed: Oct. 5, 2016

(65) Prior Publication Data

US 2017/0100769 A1 Apr. 13, 2017

(30) Foreign Application Priority Data

Oct. 8, 2015 (JP) ..... 2015-200479

(51) Int. Cl.
*B21J 13/12* (2006.01)
*B21J 5/00* (2006.01)
(Continued)

(52) U.S. Cl.
CPC ..... *B21J 13/12* (2013.01); *B21J 5/008* (2013.01); *B21J 5/02* (2013.01); *B21J 13/00* (2013.01);
(Continued)

(58) Field of Classification Search
CPC ..... B21J 5/008; B21J 5/025; B21J 5/02; B21J 13/00; B21J 13/03; B21J 13/10;
(Continued)

(56) References Cited

U.S. PATENT DOCUMENTS 1,609,785 A * 12/1926 Steen ..... B21J 5/008 72/339
2,964,838 A * 12/1960 Schober ..... B21K 1/30 29/893.34
(Continued)

FOREIGN PATENT DOCUMENTS

CN 104550607 A * 4/2015
GB 1094598 A * 12/1967 ..... B21J 13/10
(Continued)

OTHER PUBLICATIONS

Machine Translation of CN 104550607, Translated Sep. 24, 2019, 5 Pages. (Year: 2015).*
(Continued)

*Primary Examiner* — Gregory D Swiatocha
(74) *Attorney, Agent, or Firm* — Meunier Carlin & Curfman LLC

(57) ABSTRACT

A cycle is repeated a plurality of times, which includes a forging process for placing a material to be forged in a lower die and pressing the material to be forged in this state and then separating an upper die from the material to be forged; an elevation process for lifting the material to be forged by using an elevation device to separate the material to be forged from the lower die; a rotation process for rotating the material to be forged around its center by using a rotation device; and a lowering process for placing the material to be forged rotated by the elevation device in the lower die.

11 Claims, 3 Drawing Sheets

(51) Int. Cl.

| | |
|---|---|
| ***B21K 1/32*** | (2006.01) |
| ***B21J 5/02*** | (2006.01) |
| ***B21J 13/00*** | (2006.01) |
| *B21K 27/00* | (2006.01) |
| *B21J 13/14* | (2006.01) |
| *B21J 9/02* | (2006.01) |
| *B21J 9/18* | (2006.01) |

(52) U.S. Cl.
CPC ..... *B21K 1/32* (2013.01); *B21J 5/025* (2013.01); *B21J 9/025* (2013.01); *B21J 9/18* (2013.01); *B21J 13/14* (2013.01); *B21K 27/00* (2013.01)

(58) Field of Classification Search
CPC ... B21J 13/12; B21J 13/14; B21J 5/08; B21K 27/00
See application file for complete search history.

(56) References Cited

U.S. PATENT DOCUMENTS

| | | | | |
|---|---|---|---|---|
| 3,748,887 | A * | 7/1973 | Widera | B21D 45/02 72/345 |
| 5,868,026 | A | 2/1999 | Sarkisian et al. | |
| 6,044,685 | A | 4/2000 | Delgado et al. | |
| 2003/0213277 | A1* | 11/2003 | Nagao | B21J 5/02 72/354.8 |
| 2011/0126654 | A1* | 6/2011 | Lev | B22F 5/08 74/459.5 |
| 2011/0139572 | A1* | 6/2011 | Nomasa | B21J 5/02 192/219.5 |

FOREIGN PATENT DOCUMENTS

| | | | |
|---|---|---|---|
| JP | S58-209441 | A | 12/1983 |
| JP | H06-285575 | A | 10/1994 |
| JP | 2001-340938 | A | 12/2001 |
| JP | 2002035881 | A | 2/2002 |
| JP | 2003071536 | A | 3/2003 |
| JP | 2009-012059 | A | 1/2009 |
| JP | 2014168795 | A | 9/2014 |
| JP | 2015091595 | A | 5/2015 |
| WO | 2014093009 | A1 | 6/2014 |

OTHER PUBLICATIONS

European Search Report for Application No. 16192244.8 dated Mar. 10, 2017.
Machine Translation of Office Action issued in JP 2015-200479, dated Jun. 24, 2019.

* cited by examiner

METHOD AND APPARATUS FOR PRODUCING FORGING BY ROTARY FORGING

CROSS-REFERENCES TO RELATED APPLICATIONS

This application claims priority from Japanese Patent Application No. 2015-200479 filed on Oct. 8, 2015, which is incorporated herein by reference in its entirety.

TECHNICAL FIELD

The present invention relates to a method and an apparatus for producing a forging by rotary forging.

BACKGROUND ART

Rotary forging has been conventionally known as a technique for hot-forging a disk-shaped material to be forged. For example, JP 2009-012059 A discloses a method in which a rotary forging apparatus including upper and lower dies is used, the apparatus holds a material to be forged on top and bottom surfaces of the material and presses the material to perform forging, the upper die is then separated and rotated, the upper die is then pressed onto the top surface of the material to be forged again, and the above series of operations is repeated to perform hot forging.

SUMMARY OF INVENTION

However, in the example discussed in JP 2009-012059 A, in rotatingly forging a large material to be forged, it is necessary to use a large die for both the upper die and the lower die, and thus the weight of the dies themselves may increase. If a rotary mechanism is to be arranged in either of an upper die or a lower die, an extremely large mechanism may become necessary in terms of its design, and thus the costs for producing a rotary forging apparatus may increase. Therefore, it is difficult to actually employ such a rotary forging apparatus.

In this regard, a method may be used in which an upper die and a lower die are fixed and a material to be forged placed in the lower die is rotated by a predetermined angle in this state every time it is pressed. However, if a large material to be forged is used, high frictional force may be applied between the material to be forged and the surface of the lower die on which the material to be forged is placed. Accordingly, if rotational force is externally applied to the material to be forged, it is not easy to rotate the material to be forged by a predetermined angle, control the rotation angle, and stop it at a correct location. In addition, if a material to be forged is to be forcibly rotated by applying a high rotational force, unintended plastic deformation may occur in a portion to which the rotational force has been applied and the material to be forged may be cracked in the circumferential direction.

Further, in producing a large-size forging, in order to improve the efficiency of rotary forging, a pressing surface may be provided to the lower die. However, in this case, a part of the material to be forged on the side of the lower die may intrude between the pressing surfaces of the lower die during forging. Accordingly, the material to be forged cannot be rotated in a state in which it is placed in the lower die.

The present invention has been devised to solve the above-described problems, and an object of the present invention is to provide a method and an apparatus configured to produce a forging by rotary forging and capable, in rotating a large-size material to be forged, of performing rotary forging by easily rotating the material to be forged by a predetermined angle without damaging the material to be forged and also of easily rotating the material to be forged even if pressing surfaces are provided to the lower die.

According to an aspect of the present invention, A method for producing a forging by rotary-forging a material to be forged includes: a forging process for pressing an upper die against the material to be forged placed on a lower die and then separating the upper die from the material to be forged; a lifting process for lifting and separating the material to be forged from the lower die by using elevation means; a rotation process for rotating the material to be forged around a center thereof in a state in which the material to be forged is separated from the lower die; and a lowering process for placing the rotated material to be forged onto the lower die by the elevation means, and a cycle including the processes from the forging process to the lowering process is repeated a plurality of times.

It is preferable that, in the forging process, the upper die, the lower die, or the upper die and the lower die include pressing surfaces configured to press the material to be forged. The lower die may include pressing surfaces that are protruded toward the material to be forged, and it is preferable, in the lifting process, that the material to be forged be lifted so that a surface thereof on a side of the lower die comes up to a position higher than a level of the pressing surfaces of the lower die. Moreover, it is preferable that, before performing a first forging process, axis aligning means configured to align the center of the material to be forged during the rotation process be formed in a center of a surface of the material to be forged. Further, it is preferable that a process performed before the rotation process is included, in which process rotation devices configured to rotate the material to be forged in the rotation process are mounted and the rotation devices are dismounted after the rotation process. Furthermore, it is preferable that, in the rotation process, a manipulator hold the material to be forged from both side surfaces of the material to be forged to rotate the material.

According to another aspect of the present invention, a rotary forging apparatus includes: an upper die configured to press a material to be forged; a lower die on which the material to be forged is placed; elevation means configured to lift and separate the material to be forged from the lower die, lower the material to be forged, and place the material to be forged in the lower die; and rotation means configured to rotate the material to be forged around a center thereof in a state in which the material to be forged is separated from the lower die.

It is preferable that a part of the elevation means be a columnar object inserted so as to be elevatable through a hole provided in the center of the lower die. Moreover, it is preferable that a surface of the elevation means contacting the material to be forged be configured so as to function as a part of the lower die. Further, it is preferable that surfaces of the lower die, the upper die, or the lower die and the upper die include axis aligning means configured to align a rotational center of the material to be forged. Furthermore, it is preferable that the upper die, the lower die, or the upper die and the lower die include pressing surfaces. In addition, it is preferable that the rotation means be configured so as to be detachable from the rotary forging apparatus.

According to the present invention, the material to be forged is separated from the lower die by the elevation device, and accordingly, occurrence of frictional force between a surface of the material to be forged on the side of the lower die and the surface of the lower die, which is a cause of interrupted rotation of the material to be forged, can be prevented. Therefore, the material to be forged can be easily rotated without causing plastic deformation or cracks. In addition, because the material to be forged is separated from the lower die, if a pressing surface is provided to the lower die, the pressing surface protruded from the lower die would not inhibit rotation of the material to be forged. Accordingly, the material to be forged can be easily rotated. Thus, efficient rotary forging can be implemented if a large-size material to be forged is used, without requiring a large-scale rotary mechanism.

DESCRIPTION OF EMBODIMENTS

Figure 1:
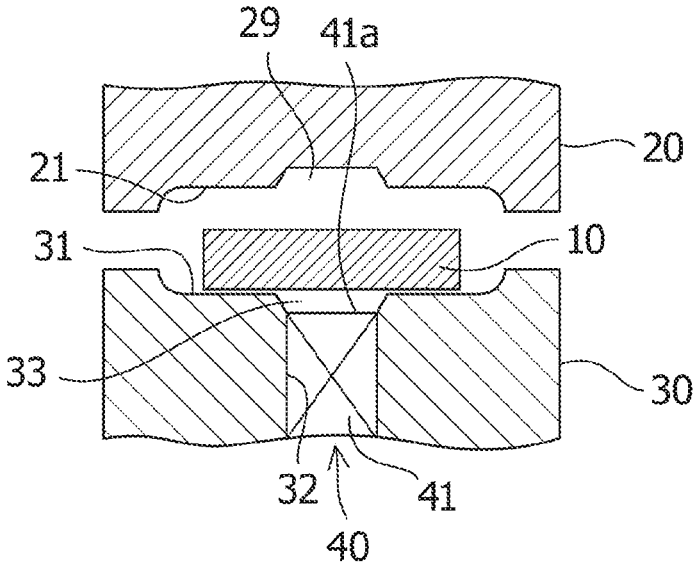
FIG. 1 is a cross-sectional diagram which illustrates an embodiment of a rotary forging apparatus according to the present invention.

Embodiments of a rotary forging method and a rotary forging apparatus according to the present invention will be described in detail below with reference to attached drawings. The present invention is not limited to the embodiments described below.

An embodiment of the rotary forging apparatus according to the present invention will be described with reference to FIGS. 1 to 4. As shown in FIGS. 1 to 4, a rotary forging apparatus according to the present embodiment includes, at least: an upper die 20 including a pressing surface 26 for pressing the material 10 to be forged; a lower die 30 on which the material 10 to be forged can be placed; an elevation device 40 configured to separate the material 10 to be forged from the lower die 30 and place the material 10 to be forged on the lower die 30; and a rotation device 50 configured to rotate the material 10 to be forged in a state in which the material 10 to be forged is separated from the lower die 30.

Figure 2:
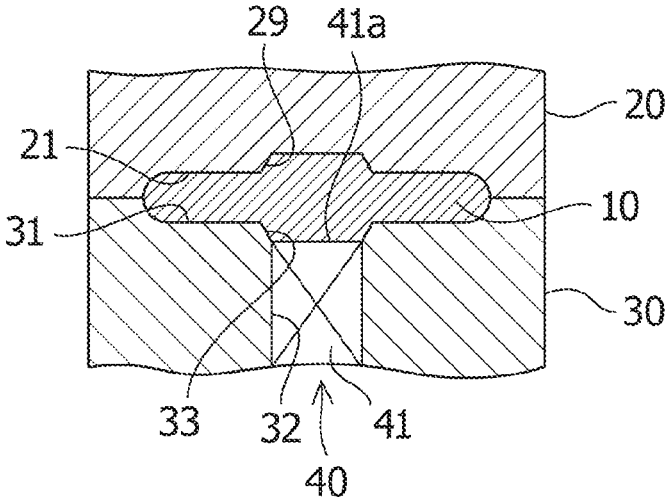
FIG. 2 is a cross-sectional diagram which illustrates an embodiment of a rotary forging apparatus according to the present invention.

As shown in FIG. 1 and FIG. 2, the upper die 20 includes a surface 21 which contacts the material 10 to be forged during pressing. The upper die 20 is caused, by a pressing device (not shown), to contact the material 10 to be forged, to be separated from the material 10 to be forged, and to be moved. The material 10 to be forged may take a columnar shape appropriate for rotary forging. The plane of the surface 21 of the upper die 20 has a circular shape. On surface 21, a plurality of pressing surfaces 26 are provided, which protrude toward the material 10 to be forged. The pressing surface 26 is formed in parts of the surface 21, and is configured to press the material 10 to be forged during forging. Moreover, non-pressing surfaces 28 are provided adjacently to the pressing surfaces 26. The non-pressing surface 28 is recessed from the material 10 to be forged. It is preferable that the pressing surfaces 26 and the non-pressing surfaces 28 provided to the upper die 20 be arranged in a rotationally symmetrical manner.

The shape of the pressing surface 26 of the upper die 20 may be a shape that enables forging of the material 10 to be forged and is not particularly limited. More specifically, it is preferable that the shape of the pressing surface 26 be a radial (substantially fan-like) shape which gradually spreads from the center of the upper die 20 toward the outer periphery thereof. It is more preferable that some convexes and concaves be provided on the pressing surface 26 that match the shape of an actual product because a near net shape can be obtained with this configuration.

An area of the pressing surface 26 of the upper die 20, i.e., an area for contact with the material 10 to be forged, may be an area wide enough to perform partial forging of the material 10 to be forged, and this area is not particularly limited. As the area of the part of the pressing surface 26 for contacting the material 10 to be forged becomes smaller, the dies can be clamped with less force. On the other hand, as the area of the part of the pressing surface 26 for contacting the material 10 to be forged becomes smaller, the number of times of hot forging increases. In addition, because the number of times of reheating during hot forging increases depending on the quality of material of the material to be forged, the contact area of the pressing surface 26 can be appropriately set according to the quality of the material 10 to be forged.

Figure 4:
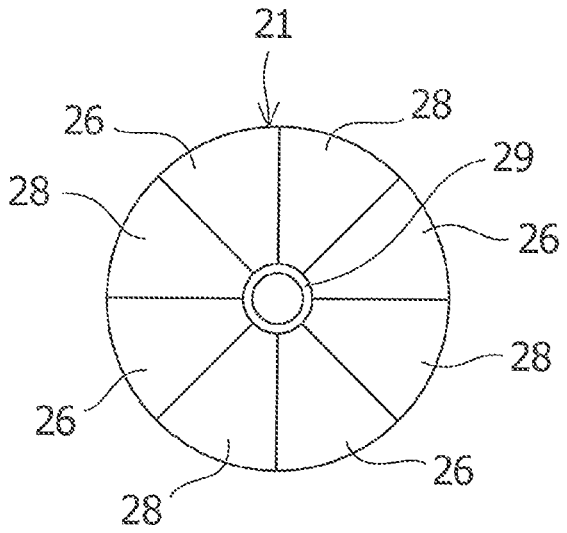
FIG. 4 is a schematic plan view which illustrates a configuration of an upper die according to an embodiment of a rotary forging apparatus of the present invention.

The number of the pressing surfaces 26 of the upper die 20 is four in FIG. 4, but it is not particularly limited. For example, as the number of the pressing surfaces 26 decreases, the dies can be clamped with less force but the number of times of hot forging increases. The number of times of reheating during hot forging increases depending on the quality of the material to be forged, and thus the number of the pressing surfaces can be set according to the material quality.

The height of the pressing surface of the upper die 20, i.e., the length from the non-pressing surface 28 to the pressing surface 26 in the direction of pressing, is not particularly limited and may be a height high enough to perform partial forging of the material 10 to be forged.

Figure 3:
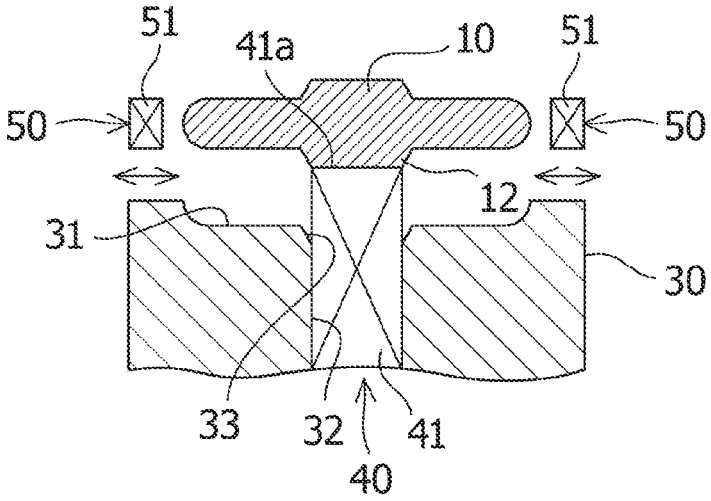
FIG. 3 is a cross-sectional diagram which illustrates an embodiment of a rotary forging apparatus according to the present invention.

As shown in FIGS. 1 to 3, the lower die 30 includes a surface 31 on which the material 10 to be forged can be placed. Similarly to the upper die 20, the plane of the surface 31 has a circular shape. In the center of the surface 31 of the lower die 30, a hole 32 is provided, in which the elevation device 40 is elevatably inserted. More specifically, the elevation device 40 is arranged at a location of the material 10 to be forged including the center thereof the material 10 to be forged when the elevation device is brought into contact with the material 10 to be forged. With this configuration, loss of balance and falling of the material 10 to be forged onto the lower die 30 can be prevented, which may otherwise occur when the material 10 to be forged is pushed up by the elevation device 40 toward the upper die. The center of the material 10 to be forged is a rotational axis around which the material 10 to be forged is rotated.

As shown in FIG. 3, the elevation device 40 includes a columnar object 41, which is engaged into the hole 32 of the lower die 30 so as to be elevatable, and a driving device (not shown) configured to elevate the columnar object 41. The columnar object 41 includes a contact surface 41*a* on which the columnar object 41 comes into direct contact with the material 10 to be forged. The columnar object 41 may be constituted by an object such as a prismatic object, columnar object, or a combination of a prismatic object and a columnar object. If a prismatic object is employed as the columnar object 41, such a configuration is useful because with this configuration, turning of the columnar object 41 in relation to the lower die 30 can be prevented due to existence of corners of the column when the material to be forged is rotated by the rotation device 50. On the other hand, if a columnar object is employed as the columnar object 41, the lower die 30 can be easily worked and the material 10 to be forged and the columnar object 41 can be rotated together. If such a configuration is employed, frictional force generated during rotation can be decreased more by previously applying a lubricant onto the side surface of the columnar object 41 having a columnar shape. The columnar object 41 can function as a knockout pin, for example, and the columnar object 41 enables easy removal of the material 10 to be forged from the lower die 30 after forging.

In addition, the columnar object 41 of the elevation device 40 functions as a part of the surface 31 of the lower die 30 during pressing. For example, the contact surface 41*a* of the elevation device 40 and the surface 31 of the lower die 30 form a continuous surface on which the material 10 to be forged is placed for forging. The elevation device 40 may be configured so that a portion of the columnar object 41 including the contact surface 41*a* is detachable. If a configuration including such a detachable portion is employed, a material with an excellent high-temperature strength can be selected for use in the detachable portion. In addition, the contact surface 41*a* can be provided with a shape of the pressing surface and a shape of the non-pressing surface similarly to the lower die 30 where necessary. If such a configuration is employed, the columnar object 41 can sufficiently function also as a part of the lower die 30.

Further, axis aligning means can be provided in the center of the surface 31 of the lower die 30. In this regard, if the center axis for the rotation has been deviated during rotation of the material 10 to be forged and if the material 10 to be forged then descends into the lower die 30 in this state, the material 10 to be forged cannot be placed in the lower die 30 so that the center axis of the material 10 to be forged is located in the center of the lower die 30. The axis aligning means is means for preventing such deviation. As shown in FIGS. 1 to 3, the surface 31 of the lower die 30 includes a recess 33 as the axis aligning means, which is provided in the center of the surface 31 and has a circular planar shape. The recess 33 includes an opening wider than a bottom surface thereof. If the recess 33 is provided to the surface 31 of the lower die 30, the position of the material 10 to be forged in relation to the lower die 30 is aligned, and thereby deviation of the center axis of the material 10 to be forged from the center axis of the circular surface 31 of the lower die 30 can be prevented. In FIGS. 1 to 3, the contact surface 41*a* of the columnar object 41 and the flat bottom surface of the recess 33 have a circular shape with the same diameter. However, the present embodiment is not limited to this configuration. More specifically, the bottom surface of the recess 33 may be configured to have a circular shape larger than the contact surface 41*a* of the columnar object 41. In addition, a recess similar to the recess 33 may be provided in the contact surface 41*a* of the columnar object 41.

The rotation device 50 is configured to rotate the material 10 to be forged around the center of the material. As shown in FIG. 3, the rotation device 50 at least includes manipulators 51, for example, and the two manipulators 51 move along both side surfaces of the material 10 to be forged in the horizontal direction so as to externally hold and rotate the material 10 to be forged. For the rotation device 50, a configuration can be employed which includes a driving device (not shown) arranged in the manipulator 51. Alternatively, a configuration may be employed in which the columnar object 41 is freely rotatable together with the material 10 to be forged, and another configuration may be employed in which the columnar object 41 is not rotated. Further alternatively, the driving device is provided to the elevation device 40 to rotate the material 10 to be forged.

The rotation device 50 is configured so that it is detachable from the upper die 20 and the lower die 30. The term "detachable" includes not only detachability of the rotation device 50 from the upper die 20, the lower die 30, and the like, but also moving of the manipulator 51 of the rotation device 50 to a standby position located on an outer periphery of the upper die 20 and the lower die 30.

Next, modes of operation of an embodiment of the rotary forging apparatus with the above-described configuration will be described, and thereby an embodiment of a rotary forging method according to the present invention will be described. In the present embodiment, the rotary forging method at least includes a forging process, a lifting process, a rotation process, and a lowering process.

(1) Forging Process

As shown in FIG. 1, in the forging process, the material 10 to be forged, having been heated to a forging temperature, is placed on the surface 31 of the lower die 30 of the rotary forging apparatus. Next, as shown in FIG. 2, the upper die 20 is pressed by a pressing device (not shown) against the material 10 to be forged. In this process, using the pressing surface 26 provided to the upper die 20, the material 10 to be forged is partially forged. In this partial forging, if the pressing surface 26 and the non-pressing surface 28 are in rotational symmetry, the force applied by the pressing can be balanced. The pressing surface 26 is preferably radially shaped (i.e., shaped in a substantially fan-like shape), which causes a region to be forged of the material 10 to be forged to extend toward the outer periphery of the upper die 20 during the rotary forging. With this configuration, the material 10 to be forged having been extended in the direction of the outer periphery can be securely partially hot-forged. After the material 10 to be forged is partially forged, the pressing device separates the upper die 20 from the material 10 to be forged.

(2) Lifting Process

As shown in FIG. 3, in the lifting process, the elevation device 40 which supports the portion of the material 10 to be forged including the center thereof ascends the material 10 to be forged toward the upper die to separate the material 10 to be forged from the lower die 30. The separation of the material 10 to be forged from the lower die 30 can be sufficiently implemented by lifting the material 10 to be forged up to a height at which the material 10 to be forged and the lower die 30 would not contact each other in the subsequent rotation process (e.g., to a height at which the material 10 to be forged is completely lifted to a position above the region of depth of the lower die 30) or to a height at which the rotation by the rotation device can be easily performed (e.g., a height at which the manipulator 51 can hold the material 10 to be forged from both side surfaces of the material 10 to be forged)

(3) Rotation Process

In the rotation process, the rotation device 50 rotates the material 10 to be forged around the center of the material 10 to be forged by a predetermined angle. More specifically, first, the rotation device 50 including the manipulators 51 is mounted onto the rotary forging apparatus main body. The manipulators 51 are moved to the standby positions on the outer periphery of the material 10 to be forged. Then the manipulators 51 move along the side surface of the material 10 to be forged so as to hold the material 10 to be forged. While holding the material 10 to be forged, the material 10 to be forged is rotated by a predetermined angle by using the driving device (not shown). With this configuration, during the rotation, the material 10 to be forged can be stably rotated without becoming off-balance.

In the rotation process, the columnar object 41 may be rotated or not rotated as the material 10 to be forged is rotated. If a configuration in which the columnar object 41 is not rotated as the material 10 to be forged is rotated is employed, the material 10 to be forged is brought into contact with the contact surface 41*a* of the columnar object 41, and therefore frictional force hindering rotation is applied to the material 10 to be forged in the center portion thereof. However, because the area of the center portion of the material 10 to be forged is extremely small in conformity with the area of the whole lower surface of the material 10 to be forged, the frictional force occurring during rotation can be suppressed to be low, and thus the material 10 to be forged can be easily stopped while controlling the rotation angle. In addition, with this configuration, the material 10 to be forged can be rotated by merely applying a low rotational force. Accordingly, unintended plastic deformation that may otherwise occur in a portion to which rotational force has been applied can be prevented. In addition, cracks that may occur in the circumferential direction of the material 10 to be forged can be prevented.

Further, it is preferable, in the rotation process, that the material 10 to be forged be rotated by a predetermined angle around the center portion thereof every time so that the portions of the material 10 to be forged, having been forged in the forging process, may be overlapped. If an angle by which a portion forged first and a portion to be subsequently forged are to be overlapped is employed as the rotation angle, a cracked seam on the material to be forged can be prevented.

After the material to be forged is rotated, the manipulators 51 are moved from the positions on both side surfaces of the material 10 to be forged, and in addition, the rotation device 50 including the manipulators 51 is dismounted from the rotary forging apparatus main body. In processes other than the rotation process, the rotation device 50 is caused to stand by at a position at which the rotation device 50 would not restrict operations of the other processes. In performing the rotation process again, the rotation device 50 is mounted to the rotary forging apparatus main body.

(4) Lowering Process

After the rotation process, the elevation device 40 lowers the material 10 to be forged toward the lower die 30 and the material 10 to be forged is placed on the upper surface 31 of the lower die 30. After the lowering process, the (1) forging process, (2) rotation process, (3) lifting process, and (4) lowering process are performed again, and the series of processes is repeatedly performed. As a result, material flow oriented along the circumference of the material 10 to be forged is generated, and thus even a large-size material to be forged can be efficiently forged by rotary forging with a low pressing force. The number of times of repeating the processes (1) to (4) is not particularly limited and can be a number of times by which a desired forging can be formed.

In addition, the recess 33 as the axis aligning means is provided on the surface 31 of the lower die 30, and thereby even if the center axis of the material 10 to be forged deviates from the center position of the lower die 30 due to the rotation of the material 10 to be forged, a raised portion 12 of the material 10 to be forged formed by the recess 33 of the lower die 30 enters the recess 33 again while it is lowered, and thus the center axis of the material 10 to be forged is appropriately aligned again even if it is once deviated from the center position of the lower die 30.

Next, another embodiment of the rotary forging apparatus according to the present invention will be described with reference to the drawings. The rotary forging apparatus according to the present embodiment is different from the above-described embodiment in terms of configurations of the lower die. Configurations of the present embodiment similar to those of the above-described rotary forging apparatus are given the same reference numerals, and the descriptions thereof will not be repeated below.

Figure 5:
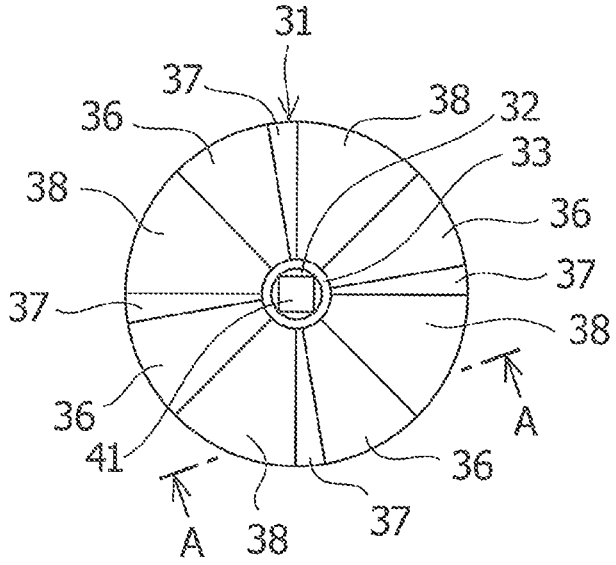
FIG. 5 is a schematic plan view which illustrates a configuration of a lower die according to another embodiment of a rotary forging apparatus of the present invention.

As shown in FIG. 5, in the present embodiment, a plurality of pressing surfaces 36 protruded toward the material 10 to be forged is provided on the surface 31 of the lower die 30. Similar to the pressing surface 26 of the upper die 20, the pressing surfaces 36 are portions formed on the surface 31 of the lower die 30 as a part thereof, which are portions for partially forging the material 10 to be forged. Moreover, non-pressing surfaces 38 are provided adjacent to the pressing surfaces 36 of the lower die 30. Further, similarly to the upper die 20, it is preferable that the pressing surfaces 36 and the non-pressing surfaces 38 provided to the lower die 30 be arranged in a rotationally symmetrical manner.

As shown in FIG. 5, similarly to the configuration of the upper die 20, it is preferable that the shape of the pressing surface 36 of the lower die 30 be substantially fan-like in shape spread from the center of the lower die 30 toward the outer periphery thereof. It is more preferable that some convexities and concavities be provided on the pressing surface 36 that match the shape of an actual product. With this configuration, a near finished shape can be obtained.

In FIG. 5, four pressing surfaces 36 of the lower die 30 are illustrated. However, the number of the pressing surfaces 36 is not particularly limited. Similar to the pressing surface 26 of the upper die 20, the number of the pressing surfaces and the contact area thereof can be set according to the material quality. It is preferable that the number of the pressing surfaces 36 of the lower die 30 and the number of the pressing surfaces 26 of the upper die 20 be the same. If a configuration is employed in which the number of the pressing surfaces 36 of the lower die 30 and the number of the pressing surface 26 of the upper die 20 are the same, it is more preferable that the opening angle in the center of the pressing surfaces 36 of the lower die 30 be the same as that in the center of the pressing surface 26 of the upper die 20.

Next, yet another embodiment of the rotary forging apparatus having the above-described configurations will be described. As shown in FIG. 5, in the forging process, the material 10 to be forged is pressed by the pressing surfaces 36 that the lower die 30 further includes and the pressing surface 26 of the upper die 20. Because the pressing surfaces 36 are provided to the lower die 30, the material 10 to be forged can be hot-forged partially and from both the top and the bottom thereof by the pressing surface 26 of the upper die 20 and the pressing surfaces 26 and 36 of the lower die 30. With this configuration, the efficiency of the hot forging by the rotary forging can be further improved. If the pressing surface 36 and the non-pressing surface 38 are in rotational symmetry as the pressing surface 26 and the non-pressing surfaces 38 are, the force applied during pressing can be balanced. In addition, similarly to the pressing surface 26, the pressing surface 36 has a radial (substantially fan-like) shape. Accordingly, during the rotary forging, the region of the material 10 to be forged is extended in the direction of the circumference of the upper die 20. With this configuration, the material 10 to be forged extended in the circumferential direction can be more securely partially hot-forged.

In the lifting process, if the pressing surfaces 36 are provided to the lower die 30, the surface of the material 10 to be forged on the side of the lower die 30 is separated from the lower die 30 to a position higher than the level of the upper surface of the pressing surface 36 of the lower die 30. When the material 10 to be forged is partially hot-forged, a part of the surface of the material 10 to be forged on the side of the lower die 30 comes between the pressing surfaces 36 of the lower die 30. Accordingly, in the rotation process, the material 10 to be forged can be rotated by separating the material 10 to be forged from the lower die 30 so that the surface of the material 10 to be forged on the side of the lower die 30 comes up to a position higher than the level of the pressing surface 36 of the lower die 30.

Portions of the upper die 20 and the lower die 30 including the pressing surfaces can be detachably configured. For example, if the pressing surfaces are constituted by a superalloy having a high-temperature strength and the other portions of the dies are constituted by inexpensive steel for hot work dies, the life of the upper die 20 and the lower die 30 can be prolonged and also the costs for producing the dies can be reduced. It is further preferable that the above-described detachable configuration be employed, because with this configuration, it becomes easy not only to correct the thickness of the portion of the die including the pressing surfaces but also to obtain very strong pressing surfaces by performing aging treatment, for example. Moreover, if the detachable configuration is employed, the height of the pressing surface can be adjusted, which enables easy adjustment of the pressing force applied to the material 10 to be forged.

Figure 6:
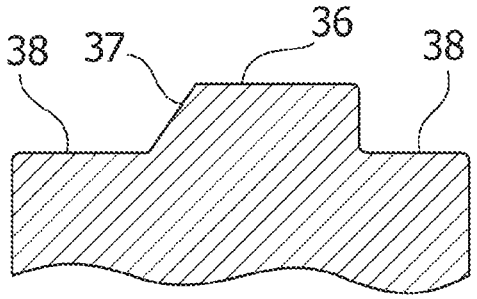
FIG. 6 is a diagram which illustrates a pressing surface of the lower die illustrated in FIG. 5 along an A-A cross section.

In addition, in the embodiments described above, modes of an apparatus or a method in which the upper die 20 and the lower die 30 include the pressing surfaces. However, the present invention is not limited thereto. More specifically, the pressing surfaces may be included only in the lower die 30. Moreover, as shown in FIG. 6 (an A-A cross section of FIG. 5), the pressing surface 36 of the lower die 30 may further include a tapered portion 37 which is formed between the upper surface of the pressing surface 36 and the non-pressing surfaces 38 and inclined by a predetermined angle. With the tapered portion 37, a cracked seam can be securely prevented. It is preferable that the tapered portion be formed also on the pressing surfaces of the upper die.

Figure 7:
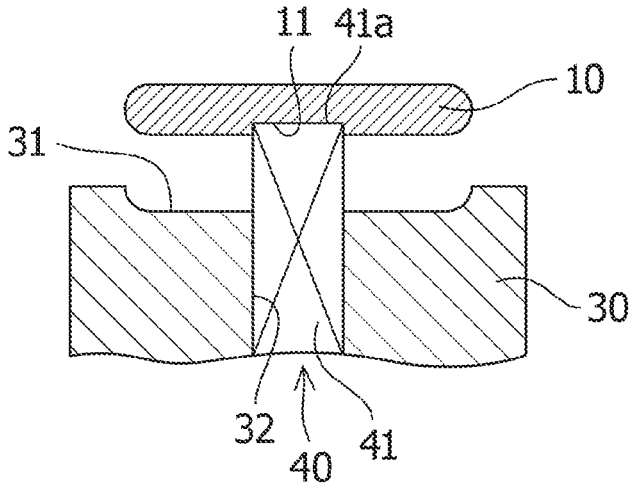
FIG. 7 is a cross-sectional diagram which illustrates another embodiment of a rotary forging apparatus according to the present invention.
Figure 8:
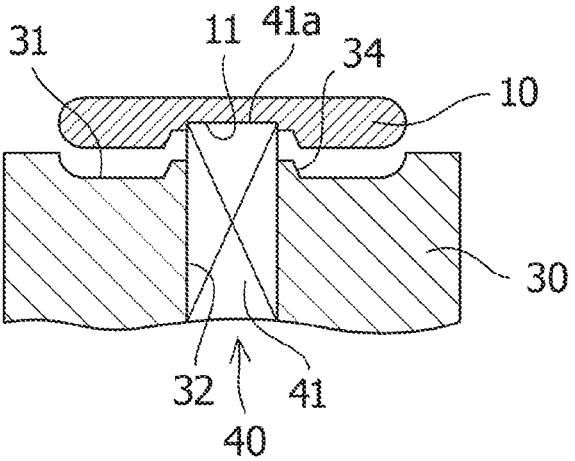
FIG. 8 is a cross-sectional diagram which illustrates another embodiment of a rotary forging apparatus according to the present invention.

Alternatively, as shown in FIG. 7, in another configuration, such axis aligning means can be provided. In this configuration, the contact surface 41*a* of the columnar object 41 can come through and be fitted in a hole 11 formed in the center of the material 10 to be forged. Because the columnar object 41 of the columnar object 41 is fitted to the hole 11, misalignment of the material 10 to be forged at the center axis thereof can be securely prevented, which may otherwise occur when the material 10 to be forged is rotated by the rotation device 50. In FIGS. 1 to 3, the recess 33 is provided to the lower die 30 as the axis aligning means. On the other hand, as shown in FIG. 8, a protrusion 34 having a plane with a circular shape can be provided in the center of the surface 31 of the lower die 30. This protrusion 34 has a flat top face and the diameter thereof becomes smaller from the surface 31 of the lower die 30 toward its top face. With this configuration also, misalignment of the material 10 to be forged at the center axis can be prevented, as it can be in the configuration using the recess 33. Further, as shown in FIG. 8, a combination of two axis aligning means can be used, such as the protrusion 33 and the hole 11. With this configuration, the material 10 to be forged can be more securely aligned at its center axis.

In addition, in the above-described embodiments, the axis aligning means such as the recess 33 and the protrusion 34 are provided on the surface 31 of the lower die 30. However, the present invention is not limited thereto. More specifically, for example, a recess 29 may be formed in the center of 21 of the upper die 20 also similarly to the lower die 30, as shown in FIGS. 1, 2, and 4. A protrusion may of course be formed instead of the recess.

In the above-described embodiments, the rotary forging method and the rotary forging apparatus for hot forging are described as examples. However, the present invention is not limited thereto. The rotary forging method and the rotary forging apparatus according to the present invention can be suitably applied as methods and apparatuses for superplastic forging and hot dies.

What is claimed is:

1. A method for producing a forging by rotary-forging a material to be forged, the method comprising:

a forging step of pressing an upper die against the material to be forged placed on a lower die and then separating the upper die from the pressed material to be forged;

a lifting step of lifting and separating the pressed material to be forged from the lower die by using an elevation member located in a center of the lower die;

a rotation step for rotating the pressed material to be forged around a center thereof in a state in which the pressed material to be forged is separated from the lower die; and a lowering step of placing the rotated and pressed material to be forged onto the lower die by the elevation member, and wherein a cycle including the steps from the forging step to the lowering step is repeated a plurality of times, wherein during a first forging step of the cycle, forming an axis aligning part in the center of the material to be forged, the axis aligning part configured to align the center of the lower die with the center of the pressed material to be forged during the lowering step, wherein the axis aligning part is formed by the upper die, the lower die, or the upper die and the lower die, wherein a surface of the elevation member contacting the material to be forged functions as a part of the lower die in the forging step, and wherein in the rotation step, a manipulator holds the pressed material to be forged from both side surfaces of the pressed material to be forged to rotate the material.

2. The production method according to claim 1, wherein in the forging step, the upper die, the lower die, or the upper die and the lower die, include pressing surfaces configured to press the material to be forged.

3. The production method according to claim 1, wherein the lower die includes pressing surfaces that are protruded toward the material to be forged, and wherein in the lifting step, the pressed material to be forged is lifted so that a surface thereof on a side of the lower die comes up to a position higher than a level of the pressing surfaces of the lower die.

4. The production method according claim 1, further comprising:

before the rotation step, mounting the manipulator to the pressed material to be forged, wherein the manipulator is configured to rotate the pressed material to be forged, and dismounting the manipulator from the pressed material to be forged after the rotation step.

5. The production method according claim 1, wherein a part of the elevation member is a columnar object that can be inserted through a hole defined in the center of the lower die, and wherein the columnar object has a prismatic cross-sectional shape as viewed in a plane that bisects a central axis of the elevation member.

6. The production method according claim 1, wherein a part of the elevation member is a columnar object that can be inserted through a hole defined in the center of the lower die, wherein the columnar object has a circular cross-sectional shape as viewed in a plane that bisects a central axis of the elevation member, and wherein a lubricant is applied onto the side surface of the columnar object before the rotation step.

7. A rotary forging apparatus comprising:

an upper die configured to press a material to be forged;

a lower die configured to receive the material to be forged;

an elevation member, located in a center of the lower die, configured to lift and separate the material to be forged from the lower die, lower the material to be forged, and place the material to be forged on the lower die; and a manipulator configured to rotate the material to be forged around a center of the material in a state in which the material to be forged is separated from the lower die, wherein a surface of the elevation member contacting the material to be forged is configured to function as a part of the lower die, wherein surfaces of the lower die, the upper die, or the lower die and the upper die, include an axis aligning part configured to align the center of the lower die with a rotational center of the material to be forged after the elevation member lifts and separates the material to be forged from the lower die, lowers the material to be forged, and places the material on the lower die, and wherein a main body of the rotary forging apparatus comprises the upper die, the lower die, the elevation member, and the axis aligning part, and wherein the manipulator is configured to be detachable from the main body.

8. The rotary forging apparatus according to claim 7, wherein a part of the elevation member is a columnar object that can be inserted through a hole defined in the center of the lower die.

9. The rotary forging apparatus according to claim 7, wherein the upper die, the lower die, or the upper die and the lower die include pressing surfaces.

10. The rotary forging apparatus according to claim 7, wherein a part of the elevation member is a columnar object that can be inserted through a hole defined in the center of the lower die, and wherein the columnar object has a prismatic cross-sectional shape as viewed in a plane that bisects a central axis of the elevation member.

11. The rotary forging apparatus according to claim 7, wherein a part of the elevation member is a columnar object that can be inserted through a hole defined in the center of the lower die, wherein the columnar object has a circular cross-sectional shape as viewed in a plane that bisects a central axis of the elevation member, and wherein a lubricant is disposed onto the side surface of the columnar object.

* * * * *